United States Patent [19]

Conklin

[11] Patent Number: 4,964,241

[45] Date of Patent: Oct. 23, 1990

[54] BLADE SHARPENER

[76] Inventor: Norman T. Conklin, 136 Marycrest La., West Seneca, N.Y. 14224

[21] Appl. No.: 405,890

[22] Filed: Sep. 11, 1989

[51] Int. Cl.[5] ..... B24B 21/10

[52] U.S. Cl. ..... 51/135 R; 51/102; 51/128

[58] Field of Search ..... 33/201; 51/135 R, 102, 51/128, 216 A, 238, 240 A, 285

[56] References Cited

U.S. PATENT DOCUMENTS

| | | | |
|---|---|---|---|
| 1,155,213 | 9/1915 | Clark . | |
| 1,394,014 | 10/1921 | Holt . | |
| 2,161,992 | 6/1939 | Battocchi | 51/102 |
| 2,375,604 | 5/1945 | Williams | 51/135 |
| 2,677,218 | 5/1954 | Lamison | 51/135 |
| 2,780,897 | 2/1957 | Radase | 51/141 |
| 2,852,895 | 9/1958 | Lamison | 51/135 |
| 2,853,837 | 9/1958 | Lamison | 51/135 |
| 2,902,801 | 9/1959 | Callaghan | 51/220 |
| 3,501,871 | 3/1970 | Anderson et al. | 51/238 R |
| 3,861,088 | 1/1975 | Grieco | 51/216 A |
| 4,050,194 | 9/1977 | Rice | 51/128 |
| 4,142,331 | 3/1979 | MacJannette | 51/102 |
| 4,259,814 | 4/1981 | Glaser et al. | 51/240 A |
| 4,320,892 | 3/1982 | Longbrake | 51/135 R |

OTHER PUBLICATIONS

Black & Decker, Sharp 'n Sand Owner's Manual.

New Dremel Belt Sander & Disc Sander in One, Jan. 1981,.

*Primary Examiner*—Frederick R. Schmidt

*Assistant Examiner*—Mark F. Frazier

*Attorney, Agent, or Firm*—Bean, Kauffman & Spencer

[57] ABSTRACT

A blade sharpener features a blade supporting ramp pivotally adjustable relative to a motor driven abrasive belt for purposes of accommodating the sharpener for use with a wide range of blade widths and shapes. The sharpener incorporates a protractor scale, a ramp scale and a compensating scale adapted for use in measurement of the blade or edge angle of a blade to be sharpened and in setting of the ramp in a desired pivotally adjusted position required to effect proper sharpening of such blade.

14 Claims, 2 Drawing Sheets

BLADE SHARPENER

BACKGROUND OF THE INVENTION

This invention relates to blade sharpening or grinding machines of the general type employing an endless abrasive belt driven for movement past a work station at which a blade to be sharpened is removably positioned.

In prior sharpening machines of this general type, the blade is supported on a ramp, which is in turn supported to adjust an included angle at which the blade is presented to the abrasive belt, and a guide device, which is arranged in a spaced, facing relationship to the ramp and serves to form an abutment for the blade being sharpened. Patents illustrative of these machines include 2,375,604; 2,677,218; 2,780,897; 2,852,895; 2,853,837 and 4,142,331.

Prior machines of the type described are readily adapted to sharpen single beveled blades, such as chisels, and relatively thick, double beveled blades of V-shaped design. However, such prior machines are not suited to grinding relatively narrow blades and accurate grinding of double beveled blades wherein compensation must be made for both edge and blade angles. Moreover, prior machines are not adapted to sharpen the full length of a cutting edge of all types of blades, nor do they incorporate in a single machine the ability to sharpen essentially all commonly available single and double beveled blades ranging from chisels to scissors and from axes to pen knives.

SUMMARY OF THE INVENTION

The present invention relates to a sharpening machine adapted for use in sharpening essentially all commonly available single and double beveled blades.

The present sharpening machine is particularly adapted for use in sharpening blades having opposite side surfaces defining a blade angle other than zero and opposite cutting edge surfaces extending from adjacent the side surfaces for defining a cutting edge of the blade having an edge angle characteristic of the type of blade being sharpened.

The machine preferably includes a power driven abrasive belt movable in a plane past a blade sharpening station; a platen arranged parallel to the plane for slidably supporting a non-abrasive surface of the belt; a blade supporting ramp having a supporting surface for supporting opposite side surfaces of the blade to position cutting edge defining surfaces of the blade in surface-to-surface engagement with an abrasive surface of the belt, wherein the supporting surface terminates in a leading edge; means for supporting the ramp at the sharpening station to selectively vary an included angle defined by the supporting surface and the belt as said leading edge is displaced along the belt in the direction of movement thereof, while being maintained parallel thereto; an edge guard for maintaining the cutting edge of the blade parallel to the leading edge of the ramp when the cutting edge surfaces engage with the belt; means for supporting the edge guard for movement towards and away from the leading edge, whereby when a blade to be sharpened has one side surface thereof disposed in surface-to-surface engagement with the supporting surface to position an adjacent cutting edge surface in engagement with the belt, the edge guard may be disposed in engagement with the other cutting edge surface adjacent the cutting edge; and included angle control means for cooperating with the supporting surface to measure a blade angle defined by the side surfaces of the blade and provide edge angle indicia for adjusting the included angle as required to effect sharpening of the knife blade to provide a desired edge angle. The control means includes a protractor arm, a protractor scale, a compensating scale and an edge angle scale carried by the support means. The protractor arm cooperates with the supporting surface to measure the blade angle and provide a visual indication thereof on the protractor scale and the compensating scale has an indicator movable therealong to provide a reference indicative of the visual indication on said protractor scale. The edge angle scale cooperates with the indicator to arrange the supporting surface to provide an included angle required to produce the desired edge angle. The platen has its opposite edge portions cut away adjacent opposite edges of the belt to allow for unrestricted access to the belt for purposes of sharpening the entire length of a cutting edge, and the edge guard has a guide surface arranged to form an included angle with the belt of between about 78° and 80° to provide for sharpening of scissors and shears.

In the preferred construction, the machine is adapted to precise selection of cutting edge angle for single beveled blades, such as chisels, by providing the support means with a second edge angle scale arranged adjacent the first mentioned edge angle scale, which has edge angle indicia equal to one half of the values of edge angle indicia on the first edge angle scale. The compensating scale has a "0" scale reading and when the indicator is arranged at such "0" scale reading, a selected value of edge angle indicia on the second edge angle scale when placed in alignment with such indicator provides a included angle equal to the selected value. Also, in the preferred construction, the planar run of the belt passing through the sharpening station is provided with an unsupported portion allowing for the sharpening of ax blades or the like having convex blade surfaces.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
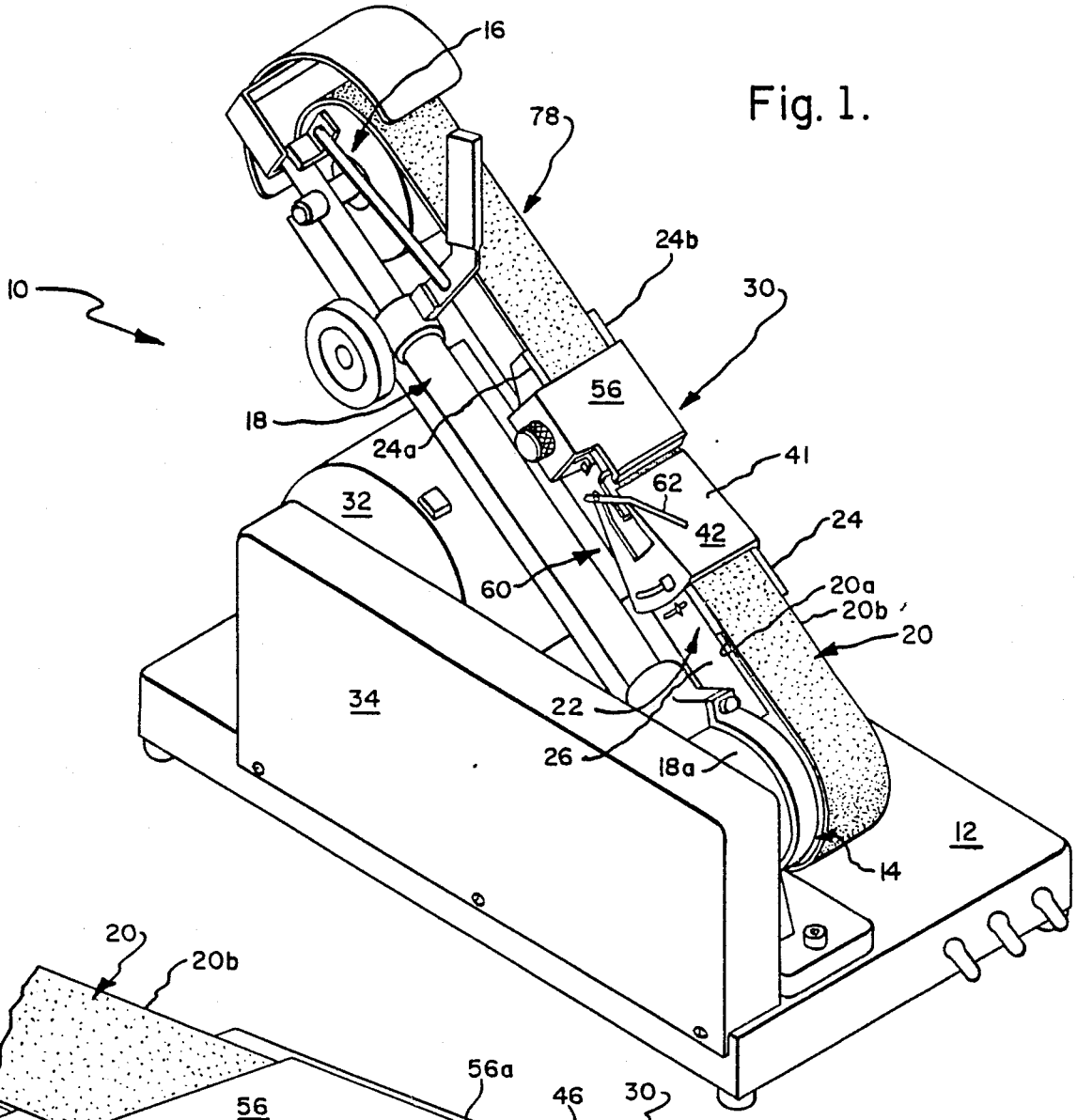
FIG. 1 is a perspective view of a knife sharpening device incorporating the present invention.

A knife blade sharpening device formed in accordance with the present invention is shown in FIG. 1 as being in the general form of power driven, coated abrasive belt grinder 10 mounted on a base 12. As is conventional, grinder 10 generally includes a drive roller 14 and an idler roller 16, which are supported for movement relative to one another by an adjustable roller support mechanism 18 for purposes of permitting the removable mounting of an endless abrasive belt 20 on the rollers and adjusting the tension of such belt. Mechanism 18 includes an end fixture 18*a*, which serves to journal drive roller 14, to mount grinder 10 on base 12 and to support a generally J-shaped frame 22 best shown in FIG. 2 as defining an elongated, planar surfaced platen 24 and first and second mounting or side flanges 26 and 28 depending from adjacent opposite, lengthwise extending side edges 24*a* and 24*b* of the platen. Platen 24 is arranged for underlying support or sliding engagement with a planar portion or run of belt 20 intermediate rollers 14 and 16 to define a grinding or work station 30 disposed essentially equidistant from such rollers. The widthwise dimension of platen 24 as measured between side edges 24*a* and 24*b*, is normally greater than the widthwise dimension of belt 20, as measured between its side edges 20*a* and 20*b* in order to accommodate for tracking displacement of the belt during use. Drive roller 14 is preferably driven by an electric motor 32 coupled thereto by a drive belt or chain, not shown, arranged within a protective housing or cover 34.

Figure 3:
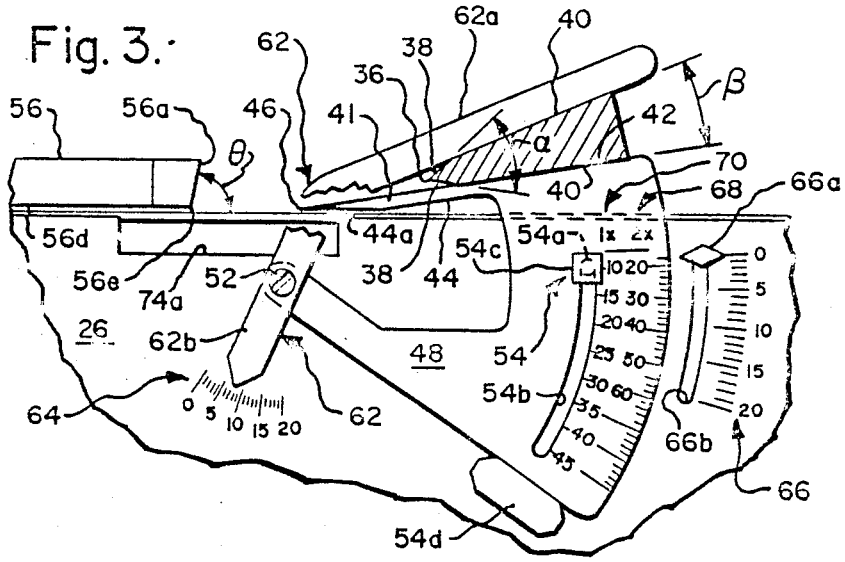
FIG. 3 is a fragmentary view taken generally along the line 2—2 in FIG. 1.
Figure 4:
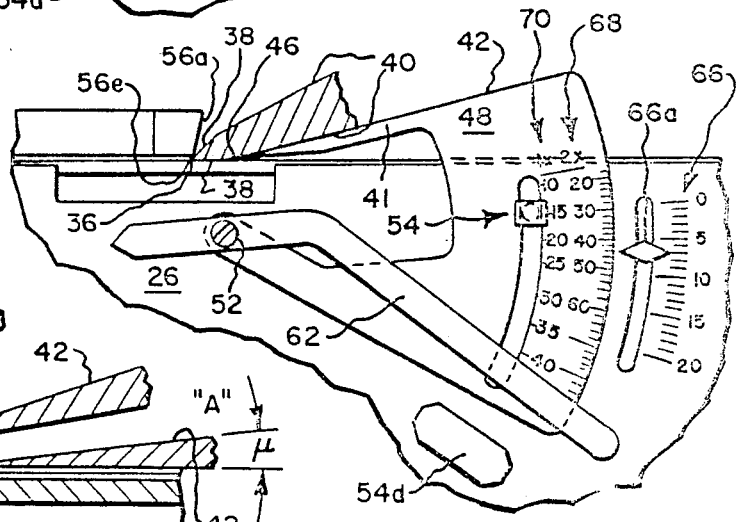
FIG. 4 is a view similar to FIG. 3, but having a knife blade arranged in sharpening engagement with an abrasive belt.

The invention to be described is particularly adapted for use in effecting proper sharpening of knife blade "B" of the type shown in FIGS. 3 and 4, which is characterized as having a cutting or knife edge 36 defined by opposite edge surfaces 38 and 38, which converge towards one another from adjacent convergent opposite side surfaces 40 and 40, wherein the edge surfaces cooperate to define an edge angle "$\alpha$" and the side surfaces cooperate to define a blade angle "$\beta$". However, as will become apparent, the invention also allows for sharpening of diverse double beveled blades and diverse single bevel blades including for example chisels, wood plane blades, and shears of various types.

Figure 5:
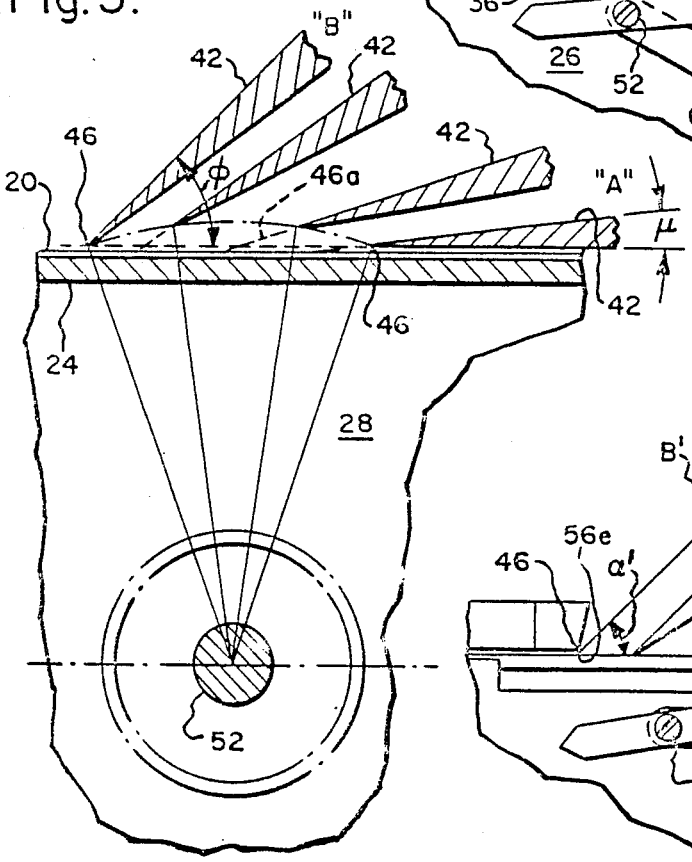
FIG. 5 is a diagrammatic view showing the permitted path of travel of a knife blade supporting ramp relative to the abrasive belt.

In accordance with the present invention, work station 30 is fitted with knife blade support means in the form of a blade supporting ramp 41, which has a planar upper blade supporting surface 42 and a lower surface 44 having a beveled end surface 44*a* cooperating with the blade supporting surface to define a knife shaped leading edge 46, and means for supporting ramp 41 including generally L-shaped support flange 48, which depend from adjacent opposite edges of lower surface 44, and a pivot shaft 52, which is supported by mounting flanges 26 and 28 and has its opposite ends journalled within apertures, not shown, provided in the support flanges. Pivot shaft 52 and the pivot axis defined thereby is parallel to leading edge 46 and supports ramp 40 such that the leading edge is parallel to and extends transversely of the planar portion of belt 20 passing over platen 24 and may be moved along an arcuate path between first and second end positions designated as "A" and "B" in FIG. 5, wherein the leading edge is disposed closely adjacent to the abrasive surface of the belt and supporting surface 42 cooperates with the belt surface to form relatively small and relatively large included angles "$\mu$" and "$\phi$". Angles "$\mu$" and "$\phi$" are on the order of approximately 9° and 45°, respectively. An angle of 45 was chosen, since the type of blades intended to be sharpened with the aid of ramp 41 would typically have edge angles not exceeding 45°. An angle of 9° was chosen, since it represents about the minimum angle which can be achieved without unduly weakening the leading edge area of the ramp or knife blade.

Ramp 41 may be releasably locked to arrange supporting surface 42 in any desired position within its range of pivotal movement by a clamp device 54. Clamp device 54 may be of any suitable construction, but is shown for purposes of illustration as including a rod 54*a*, which is supported by platen side flange 26 and freely received within an arcuate slot 54*b* formed in ramp support flange 48 and a clamping nut 54*c* threadably connected to the projecting end of the rod. Included angle $\mu$ may be automatically defined by abutting engagement of rod 54*a* with the upper end of slot 54*b* or by engagement of ramp supporting flange 48 with a stop 54*d* fixed to platen side flange 26. If desired, included angle $\phi$ may be automatically defined by engagement of rod 54*a* with the lower end of slot 54*b*.

Placement of pivot shaft 52 is critical to permitting the sharpening of narrow blades, such as are typical for example of pocket, fillet and paring knives, and to permit adjustment of the included angle required to accommodate for the range of edge angles commonly found in both double and single beveled blades. Specifically, the maximum spacing between leading edge 46 and belt 20 within the plane of supporting surface 42, such as indicated as 46*a* in FIG. 5, must be kept to a minimum such as for example on the order of about 0.132 inch in order to permit narrow blades to be properly supported by the supporting surface. Clearance between belt 20 and leading edge 46 must be kept to a minimum for the "A" and "B" positions of ramp 41, such as for example 0.015 inch for the average thickness of belts commercially available for sharpening purposes.

A generally L-shaped edge guard 56 is formed with a guide surface 56*a* and slidably mounted on platen side flange 26 by a keyway guide device 56*b* for purposes of moving the guide surface towards and away from leading edge 46 to assume a desired position in which it may be releasably locked by a clamping screw having an enlarged head 56*c*. The lower surface 56*d* of edge guard 56 is arranged to provide minimal clearance between lower edge 56*e* of guide surface 56*a* and belt 20, and the guide surface is disposed parallel to leading edge 46 and preferably arranged to define an included angle with the belt of between about 78° and 80°.

Control means generally designated as 60 is employed to cooperate with ramp supporting surface 42 for purposes of measuring blade angle $\beta$ and provide edge angle indicia for adjusting the included angle defined by the supporting surface and belt 20 within the range between angles $\mu$ and $\phi$, as required to effect sharpening of blade B to provide a desired edge angle $\alpha$. Control means 60 includes a generally L-shaped protractor arm 62, which is pivotally mounted on a free end of pivot shaft 52 intermediate its measuring and measurement indicating or pointer ends 62*a* and 62*b*, respectively; a protractor scale 64 imprinted on platen side flange 26; a compensating scale 66 including an indicator 66*a* slidably movable along the scale within an arcuate slot 66*b* formed in platen side flange 26; and a first edge angle scale 68 imprinted on ramp support flange 48 in facing relation to the compensating scale. Protractor and compensating scales 64 and 66 may be provided with angle indicating indicia of from zero degrees to about twenty degrees and edge angle scale 68 may be provided with indicia from eighteen degrees to about sixty degrees. Preferably, there is also provided a second edge angle scale 70 arranged adjacent first edge angle scale 68 and having indicia equal to one half of the values of the latter.

Figure 2:
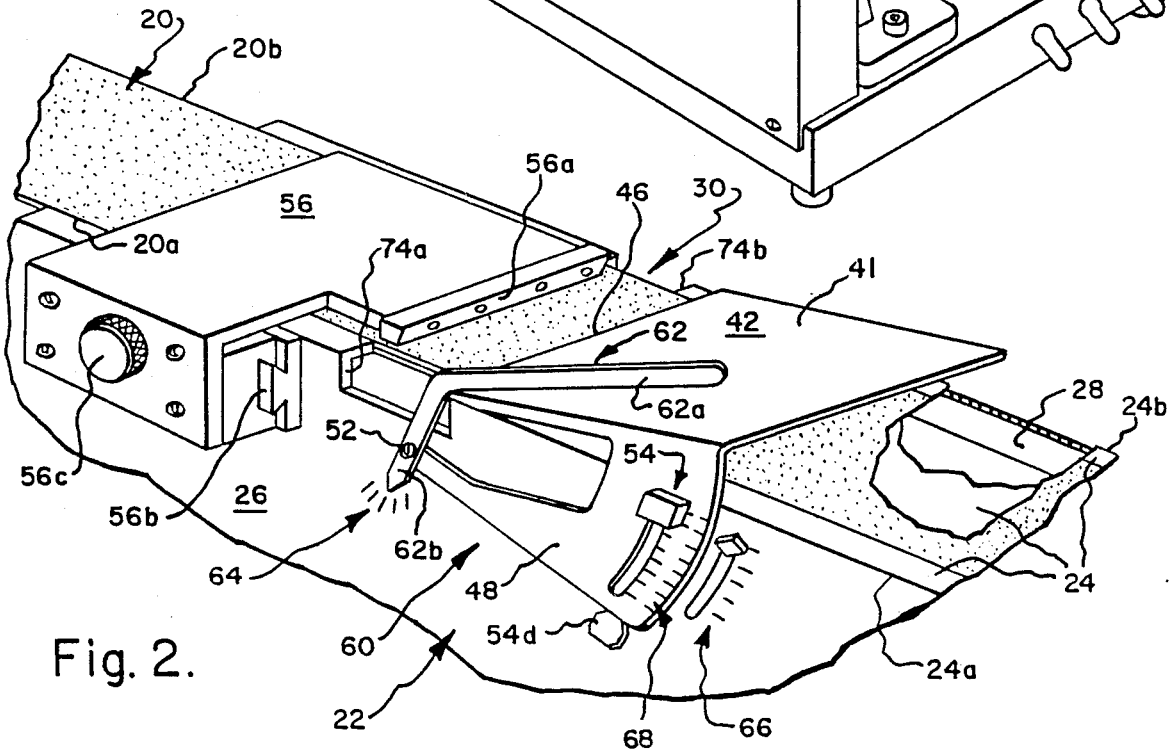
FIG. 2 is an enlarged perspective view of an area of FIG. 1.

By referring to FIGS. 2 and 3, it will be noted that opposite edge portions of platen 24 and adjacent portions of its side flanges 26 and 28 are cut away to provide clearance recesses 74*a* and 74*b*. Clearance recesses 74*a* and 74*b* extend lengthwise of platen 24 at least through a distance coextensive with the path of movement of leading edge 46, and are spaced apart from one another, such that their adjacent or inner edges are essentially aligned with belt edges 20*a* and 20*b* when belt 20 tracks centrally of the platen with such belt edges arranged equidistant from platen edges 24*a* and 24*b*.

It will also be noted by referring to FIG. 1, that platen 24 terminates in a spaced relationship relative to idler roller 16, such that the planar run of belt 20 is unsupported in a second work station 78 disposed intermediate the platen and the idler roller.

Operations of machine 10 will first be described with reference to its use in sharpening a double beveled blade B having a blade angle $\beta$ greater than zero degrees, as depicted in FIGS. 3 and 4. As a first step, ramp 41 is set in its reference position defined by engagement of support flange 48 with stop 54*d*, so as to position ramp supporting surface 42 at its minimum included angle. When ramp 41 is thus positioned, the 18° indicia appearing on first edge angle scale 68 is aligned with the 0° indicia appearing on compensating scale 66. A blade B to be sharpened in then laid on ramp 41 with one of its side surfaces 40 disposed in surface-to-surface engagement with supporting surface 42 and moved towards or away from leading edge 46 until such time as protractor arm measuring end 62*a* can be disposed flatwise or in parallel engagement with the opposite or unsupported one of side surfaces 40 of the blade. When this occurs, protractor arm indicating end 62*b* points to a value on protractor scale 64, which is equal to one half of the blade angle $\beta$ measured by protractor arm measuring end 62*a* and supporting surface 42. This value is then used by a machine operator to position indicator 66*a* along compensating scale 66.

Although blade edge angles vary greatly, they are nonetheless relatively constant for each specific type of blade, as would be well known to a person skilled in the sharpening of blades or which could be made known to an unskilled operator of machine 10 by reference to a printed listing of edge angles for common types of blades. In general, heavy duty, medium duty and light duty blades have edge angles of between 40°–50°, 30°–40°, and 20°–30°, respectively, with extremely sharp blades having edge angles of less than 20°. The exact edge angle to be chosen within each range would be selected based on an operator's knowledge or by reference to written record of the edge angle chosen when a given blade was previously sharpened and by making inquiry as to how such blade performed.

Once an edge angle has been chosen on the foregoing basis, ramp 41 is pivoted upwardly as required to position the chosen edge angle depicted on first edge angle scale 68 in alignment with previously positioned indicator 66*a* and the ramp locked in position by tightening clamp device 54 and protractor arm 62 pivoted out of the way, as indicated in FIG. 4. Blade B is then moved downwardly along supporting surface 42 until a first of edge surfaces 38 to be sharpened is placed in engagement with belt 20 and thereafter edge guard 56 is moved towards ramp 41 as required to position lower edge 56*e* of guide surface 56*a* in engagement with the opposite or the non-engaged edge surface 38. Blade B is now properly positioned to proceed with the sharpening operation first by removal of material from one edge surface and then the other to provide a desired edge angle. For long blades, it will be necessary to draw the blade transversely of belt 20 while in engagement with edge guard 56 in order to effect sharpening thereof throughout its entire length. The provision of clearance recesses 74*a* and 74*b* permits movement of a blade mounting handle, not shown, relatively inwardly of platen side flanges 26 and 28 as required to permit sharpening of that end portion of a blade cutting edge disposed immediately adjacent to the handle.

As by way of specific example, the blade depicted in FIGS. 3 and 4 is a heavy duty blade whose blade angle, as measured by protractor arm 62, is 14°, which results in protractor arm indicating end pointing to 7° on protractor scale 64. Indicator 66*a* is accordingly moved along compensating scale 66 until it points to 7°. At this point, indicator 66*a* also points to about 32° on first edge angle scale 68, but a 32° edge angle is obviously too sharp for a heavy duty blade. Accordingly, a more appropriate edge angle of 45° is chosen and ramp 41 pivoted upwardly until this chosen edge angle is aligned with indicator 66*a* before locking the ramp in position. With a measured blade angle of 14° and a selected edge angle of 45°, ramp 41 is set such that supporting surface 42 forms an included angle with belt 20 of 15.5°, i.e. $(45°-14°)=15.5°$. As will be apparent by examination, the cutting edge defining edge surfaces of most double beveled blades are too small to allow accurate measurement of their edge angle and thus resort must normally be made to the arbitrary selection of an edge angle within the range of edge angles common for a given type of blade.

Double beveled blades of the type having parallel side surfaces, e.g. certain butcher's knives, may be sharpened by machine 10 by setting indicator 66*a* to 0° on compensating scale 66, since there is no blade angle to be compensated for, and then placing an arbitrarily selected, or in some limited number of cases measured, edge angle on scale 68 in alignment with the indicator. In the case of a butcher's knife, which is required to be quite sharp, a selected edge angle might be 20°. As with the previous example, the blade is sharpened by removal of metal first from one edge surface and then the other.

Figure 6:
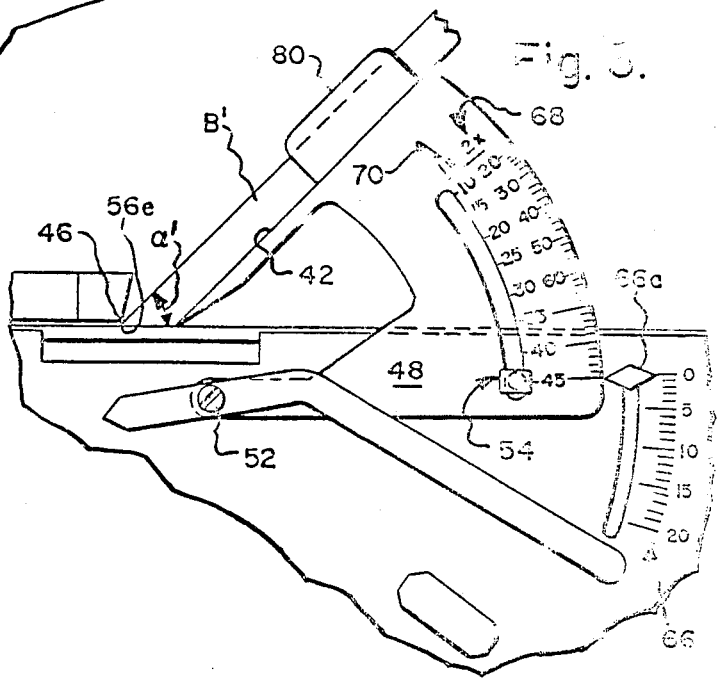
FIG. 6 is a view similar to FIG. 4, but showing a chisel arranged in sharpening engagement with the abrasive belt.

A single beveled blade, e.g. chisel, wood plane blade, draw blade, etc., B′, may also be sharpened by the present machine. For relatively thick blades, where the width of a single edge surface is relatively large, ramp 41 may be adjusted by simply observing when such edge surface is placed parallel to belt 20. However, on most thin, single beveled blades, the width of the edge surface is too small to allow for accurate visual measurement and, as in the case of double beveled blades previously described, reference must be made to arbitrary selection of an edge angle within the range of edge, angles common for a given type of blade. When an edge angle is selected, ramp 41 is adjusted by first setting indicator 66*a* to "0" on compensating scale 66 and then placing the selected edge angle on second scale 70 in alignment with the indicator. As depicted in FIG. 6, the setting of the 45° indicia on second scale 70 in alignment with indicator 66*a* provides for sharpening of blade B′ to produce an edge angle $\alpha'$ of 45°. For relatively narrow single beveled blades, such as found in wood chisels, it would be preferable to removably mount a guide rib 80 along one edge of supporting surface 42, so as to provide a reference guide surface, not shown, which is disposed at a right angle to leading edge 46, in order to ensure that the cutting edge of the chisel, when sharpened, is parallel to the leading edge.

Shearing blades, including for example, scissors, pruning shears, hedge and grass clippers, and wire cutters, have matching blades and edge angles may be sharpened with the present machine by utilizing guide surface 56*a* of edge guard 56. Specifically, it is contemplated that the inner or facing surfaces of the shearing blades would be placed one at a time in engagement with guide surface 56*a* to arrange their edge surfaces in engagement with belt 20. Guide surface 56*a* is arranged to form with belt 20 a permanent angle $\theta$ of between 78° and 80°, since with few exceptions an edge angle within this range is common to a wide variety of shearing blades. When employing machine 10 to grind shearing blades, belt 20 should be driven to move in a clockwise direction, as viewed in FIG. 1 and each blade drawn across the belt positionally engaged with guide surface 56*a*. Right handed shearing blades would be sharpened with their handles disposed adjacent belt edge 20*a*, and left handed shearing blades would be sharpened with their handles disposed adjacent belt edge 20*b*.

The blades of axes, hatchets and cleavers commonly have convex or rounded side surfaces, in order to increase the volume of metal behind their cutting edges and thus add strength to the blades. Cutting edges of blades of this type are preferably sharpened by removing metal over a large area of each convex side surface extending rearwardly from the cutting edge. The provision of second work station 78 accommodates present machine 10 to sharpening this type of blade, since it allows the unsupported belt, when its tension is appropriately reduced, to conform to the curvature of the side surfaces of the blade.

The characteristics of a blade to be sharpened will control the characteristics of the belt to be fitted to machine 10 for performing a sharpening operation, and typically it would be preferable to use in succession multiple belts having progressively smaller grit size to both speed removal of metal and provide a proper final surface finish for the blade.

What is claimed is:

1. In a sharpening device for sharpening a blade having a cutting edge defined by cutting edge surfaces converging towards one another from adjacent opposite side surfaces of said blade, said cutting edge surfaces defining an edge angle and said side surfaces defining a blade angle, the improvement for sharpening said blade to provide a desired edge angle comprising in combination:

means for driving abrasive means for movement along a path of travel;

support means having a planar supporting surface for supporting said side surfaces by surface-to-surface to position said edge surfaces in engagement with said abrasive means, said support means being adjustable for varying an included angle defined by said supporting surface and said abrasive means to arrange said edge surfaces in engagement with said abrasive means for removing material therefrom as required to provide said desired edge angle; and included angle control means for cooperating with said supporting surface to measure said blade angle and provide edge angle indicia for adjusting said included angle as required to effect sharpening of said blade to provide said desired edge angle.

2. A device according to claim 1, wherein said abrasive means is an abrasive belt having a planar portion arranged adjacent said support said means, said support means includes a beveled surface cooperating with said supporting surface to define a knife-shaped leading edge disposed to extend parallel and transversely of said planar portion of said belt, said support means is pivotally supported for moving said leading edge along an arcuate path relative to said abrasive belt about an axis between a first position in which said included angle is relatively small and a second position in which said in angle is relatively large.

3. A device according to claim 2, wherein said relatively and relatively large included angles are approximately 9° and 45°, respectively.

4. A device according to claim 2, wherein said control means includes a protractor arm, a protractor scale, a compensating scale and an edge angle scale carried by said support means, said protractor arm cooperating with said supporting surface to measure said blade angle and provide a visual indication thereof on said protractor scale, said compensating scale having an indicator movable therealong to provide a reference indicative of said visual indication on said protractor scale, and said edge angle scale cooperating with said indicator to arrange said supporting surface to provide said included angle required to produce said desired edge angle.

5. A device according to claim 4, wherein said relatively small and relatively large included angles are approximately 9° and 45°, respectively.

6. A device according to claim 4, wherein said support means carries a second edge angle scale arranged adjacent the first said edge angle scale and having edge angle indicia equal to one half of the values of edge angle indicia on said first said edge angle scale, said compensating scale has a "0" scale reading and when said indicator is arranged at said "0" scale reading a selected value of said edge angle indicia on said second edge angle scale when placed in alignment with said indicator provides said included angle equal to said selected value.

7. A device according to claim 2, wherein said device includes a guard adjustably movable along said planar portion of said abrasive belt in the direction of said path of travel towards and away from said support means, said guard includes a planar guide surface disposed in facing, parallel relation to said leading edge for removable engagement with a blade supported on said supporting surface adjacent said cutting edge thereof, said planar guide surface forming an included angle with said planar portion of said abrasive belt of between about 78° and 80°.

8. A device according to claim 7, wherein said device includes an elongated platen extending lengthwise of said planar portion of said abrasive belt and arranged in underlying supporting engagement therewith in alignment with said guard and said support means, said platen having opposite side edge portions disposed essentially parallel to and outwardly of opposite side edges of said belt and having a pair of access recesses extending inwardly of said opposite side edge portions into an underlying relation to said opposite side edges of said belt, said access recesses being coextensive with said arcuate path of said leading edge.

9. A device according to claim 8, wherein said control means includes a protractor arm, a protractor scale, a compensating scale and an edge angle scale carried by said support means, said protractor arm cooperating with said supporting surface to measure said blade angle and provide a visual indication thereof on said protractor scale, said compensating scale having an indicator movable therealong to provide a reference indicative of said visual indication on said protractor scale, and said edge angle scale cooperating with said indicator to arrange said supporting surface to provide said included angle required to produce said desired edge angle.

10. A device according to claim 9, wherein said support means carries a second edge angle scale arranged adjacent the first said edge angle scale and having edge angle indicia equal to one half of the values of edge angle indicia on said first said edge angle scale, said compensating scale has a "0"scale reading and when said indicator is arranged at said "0" scale reading a selected value of said edge angle indicia on said second edge angle scale when placed in alignment with said indicator provides said included angle equal to said selected value.

11. A powered sharpener for sharpening a blade having a cutting edge defined by cutting edge surfaces converging towards one another from adjacent opposite side surfaces of said blade, said cutting edge surfaces defining an edge angle and said opposite side surfaces defining a blade angle, said sharpener comprising:

means including a platen for supporting a power driven abrasive belt for movement in a plane past a blade sharpening station;

a blade planar supporting ramp having a supporting surface for supporting said opposite side surfaces for surface-to-surface engagement and terminating in a leading edge;

means for supporting said ramp at said station to selectively vary an included angle defined by said supporting surface and said belt as said leading edge is displaced along said plane in the direction of movement of said belt, while being maintained parallel thereto;

an edge guard having a guide surface disposed parallel to said leading edge of said ramp;

means for supporting said edge guard for reciprocating movement in said direction of movement towards and away from said leading edge, whereby when a blade to be sharpened has one side surface thereof disposed in surface to surface engagement with said supporting surface to position an adjacent one of said cutting edge surfaces in engagement with said belt, said edge guard may be disposed in engagement with a surface of said blade opposite to that supported by said ramp; and included angle control means for cooperating with said supporting surface to measure said blade angle and provide edge angle indicia for adjusting said included angle as required to effect sharpening of said blade to provide said desired edge angle.

12. A sharpener according to claim 11, wherein said ramp is pivotally supported for moving said leading edge along an arcuate path relative to said belt about a pivot axis between first and second position in which said included angle is relatively small and large, respectively.

13. A sharpener according to claim 12, wherein said control means includes a protractor arm, a protractor scale, a compensating scale and an edge angle scale carried by said support means, said protractor arm cooperating with said supporting surface to measure said blade angle and provide a visual indication thereof on said protractor scale, said compensating scale having an indicator movable therealong to provide a reference indicative of said visual indication on said protractor scale, and said edge angle scale cooperating with said indicator to arrange said supporting surface to provide said included angle required to produce said desired edge angle.

14. A sharpener according to claim 13, wherein said support means carries a second edge angle scale arranged adjacent the first said edge angle scale and having edge angle indicia equal to one half of the values of edge angle indicia on said first said edge angle scale, said compensating scale has a "0" scale reading and when said indicator is arranged at said "0" scale reading a selected value of said edge angle indicia on said second edge angle scale when placed in alignment with said indicator provides said included angle equal to said selected value.

* * * * *

UNITED STATES PATENT AND TRADEMARK OFFICE

CERTIFICATE OF CORRECTION

PATENT NO. : 4,964,241

DATED : October 23, 1990

INVENTOR(S) : Norman T. Conklin

It is certified that error appears in the above-identified patent and that said Letters Patent is hereby corrected as shown below:

Col. 3, line 64 - "45" should be --45°--.

Col. 6, line 30 - "(45°-14°) = 15.5° should be $$--\frac{(45°-14°)}{2} = 15.5° --$$

Col. 8, line 13 - the second occurrence of "in" should be --included--.

Col. 8, lines 15-16 - "relatively and" should be --relatively small and--.

Signed and Sealed this

Tenth Day of March, 1992

*Attest:*

*Attesting Officer*

HARRY F. MANBECK, JR.

*Commissioner of Patents and Trademarks*